United States Patent [19]

Polastri

[11] Patent Number: 4,676,126

[45] Date of Patent: Jun. 30, 1987

[54] ADJUSTABLE WRENCH HEAD FOR SPANNER NUTS

[75] Inventor: Robert S. Polastri, Branford, Conn.

[73] Assignee: Avco Corporation, Providence, R.I.

[21] Appl. No.: 507,978

[22] Filed: Jun. 27, 1983

Related U.S. Application Data

[63] Continuation of Ser. No. 389,999, Jun. 18, 1982, abandoned, which is a continuation of Ser. No. 181,305, Aug. 25, 1980, abandoned.

[51] Int. Cl.[4] ..... B25B 13/10

[52] U.S. Cl. ..... 81/176.3; 81/128

[58] Field of Search ..... 81/90, 90 C, 90 D, 128, 81/442, 461, 176.1, 176.15, 176.2, 176.3

[56] References Cited

U.S. PATENT DOCUMENTS

| | | | |
|---|---|---|---|
| 976,391 | 11/1910 | O'Hare | 81/90 C X |
| 1,263,202 | 4/1918 | Brown | 81/90 C X |
| 2,389,954 | 11/1945 | Burns | 81/90 C X |
| 2,403,264 | 7/1946 | Cormier | 81/90 C X |
| 2,803,981 | 8/1957 | Stoecker | 81/90 C |

*Primary Examiner*—Frederick R. Schmidt
*Assistant Examiner*—Debra S. Meislin
*Attorney, Agent, or Firm*—Perman & Green

[57] ABSTRACT

An adjustable wrench head (10) is disclosed for use in conjunction with spanner nuts of various sizes, each spanner nut having a plurality of locking recesses therein. More particularly, a wrench head is provided which includes a central elongated driving spindle (20) having a plurality of opposed pairs of planar guide rails (22, 24) projecting radially outwardly therefrom. Each pair of guide rails defines a channel (26), which is adapted to receive a generally rectangular insert (28), with the insert being radially movable therein, relative to the central spindle. Each insert is provided with a tang (30) which projects axially beyond the front end of the spindle for engagement with a locking recess of the spanner nut. The radial position of the inserts are adjusted and secured such that the tangs thereof are spaced from the center of the spindle a distance corresponding to the radius of the spanner nut. Preferably, a plurality of planar webs (34) are provided which extend between one guide rail (22) of one pair and the adjacent guide rail (24) of another pair. The planar webs (34) function to add structural rigidity to the wrench head (10) and prevent deflection of the guide rails.

1 Claim, 6 Drawing Figures

ADJUSTABLE WRENCH HEAD FOR SPANNER NUTS

This is a continuation of application Ser. No. 389,999 filed June 18, 1982, now abandoned, which is a continuation of Ser. No. 181,305, Aug. 25, 1980, now abandoned.

TECHNICAL FIELD

The subject invention relates to an adjustable wrench head for use with different size spanner nuts. More particularly, the subject invention provides an adjustable wrench head with radially movable inserts, which can be adjusted to accommodate the locking recesses of spanner nuts having different diameters.

BACKGROUND OF THE PRIOR ART

In the construction of machinery, and more particularly in the design of aircraft engines, frequently spanner nuts are utilized to secure gears or wheels on threaded shafts. A spanner nut is generally a circular piece of metal, having a central threaded aperture adapted to engage the threaded end of a shaft. The spanner nut includes a plurality of locking recesses spaced around the circumference thereof to facilitate the tightening of the nut. More specifically, in one type of spanner nut, generally rectangular recesses are formed in the perimeter thereof. In another type of spanner nut, rectangular recesses are formed in one of the planar faces of the nut. Spanner nuts, rather than the more common hexagonal nuts are utilized in applications, such as aircraft engines, where the total weight of the device must be minimized. More specifically, when dealing with large diameter shafts, the associated hexagonal nuts are relatively massive. In contrast, spanner nuts, which can be substituted for hexagonal nuts in many applications, are relatively lightweight. Thus, in a typical aircraft engine, the gear boxes and shafts are provided with spanner nuts of various diameters to reduce the overall weight of the engine.

Heretofore, wrenches designed to accommodate spanner nuts have been designed with fixed diameters. More specifically, prior art wrenches are designed to be used with a spanner nut having a particular diameter. Each prior art wrench is provided with a plurality of axially projecting tangs which correspond to the radial location of the locking recesses in a particular nut. Thus, in order to work on an aircraft engine, which is often provided with fifteen or more spanner nuts of different diameters, it is necessary for the mechanic to have at least fifteen different sized wrenches, corresponding to the nuts to be tightened. Clearly, the relatively large number of wrenches necessary to work on an engine is both inconvenient and expensive. In addition, when a manufacturer produces an engine, a spanner nut will often be used which conforms to the particular design requirements of the shaft, but which will not be of a standard size. In the latter situation, it is necessary to have a special wrench fabricated to accommodate the non-standard spanner nut. The need to order or fabricate an atypical wrench often results in substantial production delays. Accordingly, it would be desirable to provide an adjustable wrench which can accommodate a plurality of spanner nuts having various diameters. By this arrangement, the necessity of providing a large number of different sized spanner wrenches is eliminated.

Therefore, it is an object of the subject invention to provide a new and improved wrench head which is adapted to accommodate spanner nuts of various diameters.

It is another object of the subject invention to provide a new and improved wrench head having inserts which are radially adjustable to accommodate various spanner nuts.

It is a further object of the subject invention to provide a new and improved adjustable wrench head which is provided with sufficient structural rigidity to withstand conventional torque loads.

SUMMARY OF THE INVENTION

In accordance with these and many other objects, the subject invention provides for an adjustable wrench head adapted for use with spanner nuts of various sizes. More particularly, a wrench head is provided which includes an elongated cylindrical driving spindle having a plurality of opposed pairs of planar guide rails which project radially outwardly from the spindle. Each pair of guide rails defines a channel, with the channels being spaced symmetrically about the periphery of the spindle. Each channel is configured to receive a rectangular insert which is radially movable therein, relative to the spindle. A locking means is provided for affixing the radial location of the insert within the associated channel.

Each insert includes a tang, which projects axially outwardly beyond the front end of the spindle, and is adapted to engage with a locking recess of a spanner nut. In use, the radial location of the inserts are adjusted such that the position of the tangs coincide with the locking recesses of the spanner nut to be rotated. The wrench head is readily connectable to a driver arm such as a torque handle or a power tool for supplying sufficient force for rotating the spanner nut. Preferably, the wrench head further includes a plurality of planar webs which extend between a guide rail of one pair to the adjacent guide rail of another pair. The planar webs function to increase the structural rigidity of the wrench head and prevents the deflection of the planar guide rails.

Further objects and advantages of the subject invention will become apparent from the detailed description in conjunction with the following drawings in which:

DETAILED DESCRIPTION OF THE PREFERRED EMBODIMENT

Figure 1:
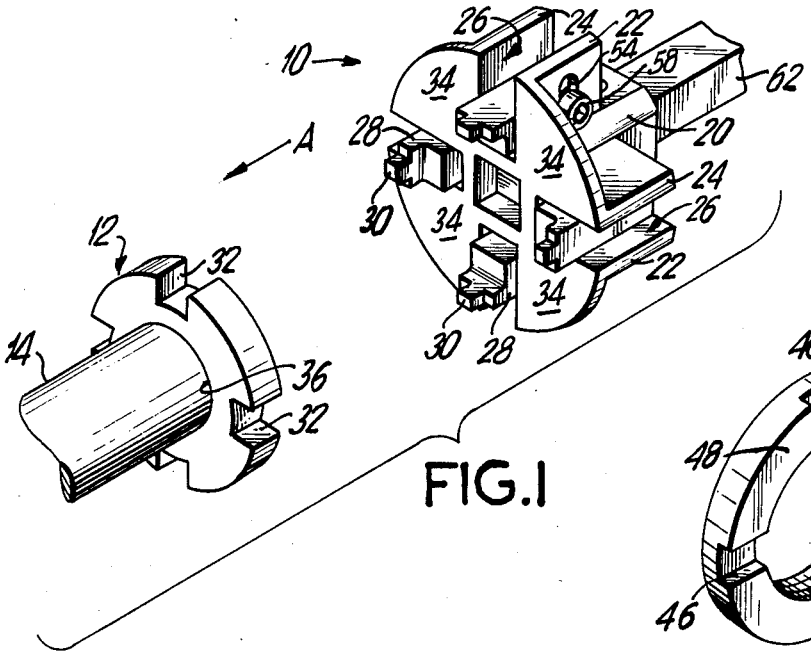
FIG. 1 is a perspective view of the new and improved adjustable wrench head of the subject invention, and a typical spanner nut having locking recesses therein, the latter being shown on the left and the former being shown on the right.

Referring to FIG. 1, there is illustrated a perspective view of the new and improved adjustable wrench head 10 of the subject invention shown on the right, and a typical spanner nut 12, tightened onto a shaft 14 shown on the left. Briefly, the wrench head 10 of the subject invention includes an elongated central spindle 20 and a plurality of pairs of planar guide rails 22 and 24 projecting axially outwardly therefrom. Each pair of guide rails 22 and 24 cooperate to define channels 26 which are adapted to receive generally rectangular inserts 28. The inserts 28 are radially movable within the channels 26, relative to the spindle 20. Each insert 28 is provided with a tang 30 which projects axially outwardly beyond the front of the wrench head 10. The tangs are adapted to engage with the locking recesses 32 of the spanner nut 12. Preferably, the wrench head 10 includes a plurality of planer web portions 34 which extend between one guide rail 22 of one pair and the adjacent guide rail 24 of another pair. The webs 34 function to structurally rigidify the wrench head 10 and prevent the deflection or distortion of the guide rails 22 and 24.

Referring to the left side of FIG. 1, a spanner nut 12 is illustrated, which is generally circular in configuration and is provided with a plurality of generally U-shaped locking recesses 32 that are cut into the peripheral edge of the nut. Spanner nut 12 is provided with a central threaded aperture 36 (not shown) to enable the nut to be tightened about the end of shaft 14. In operation of the wrench head 10 of the subject invention, the tangs 30 of the inserts 28 are receivable in the locking recesses 32 of the spanner nut 12 such that the rotational torque forces of the head are transmitted to the nut, as more fully described hereinafter.

Figure 2:
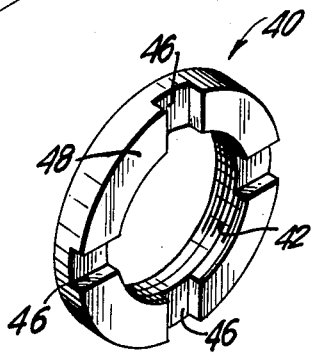
FIG. 2 is a perspective view of another type of spanner nut.

Referring to FIG. 2, another type of spanner nut 40 is illustrated. Spanner nut 40 is generally circular in configuration and includes a central threaded aperture 42. In this alternate type of spanner nut 40, the U-shaped locking recesses 46 are provided in one of the planer faces 48 thereof. As explained more fully hereinbelow, the tangs 30 of the inserts 28 of the subject invention are also capable of engagement with these face type locking recesses 46 of spanner nut 40.

Figure 3:
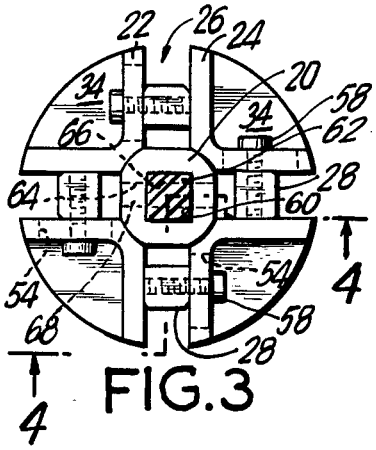
FIG. 3 is a rear elevational view of the adjustable wrench head of the subject invention.
Figure 5:
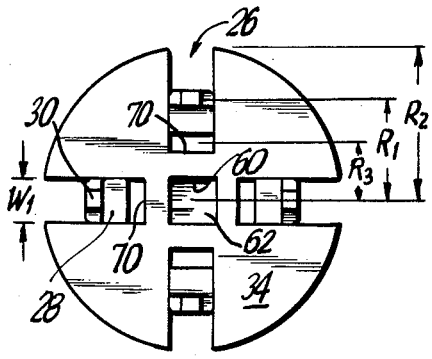
FIG. 5 is a front elevational view of the adjustable wrench head of the subject invention.
Figure 4:
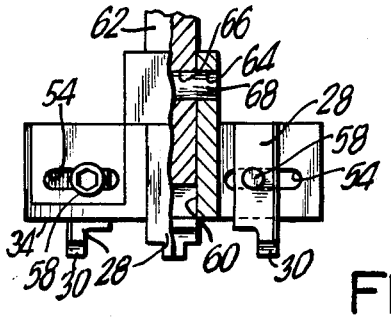
FIG. 4 is a cross sectional view of the adjustable wrench head of the subject invention, taken along the line 4—4 in FIG. 3.

Referring to FIGS. 3–5, the preferred embodiment of the adjustable wrench head 10 of the subject invention is illustrated. More specifically, the wrench head 10 includes a central spindle 20 having a plurality of opposed pairs of guide rails 22 and 24 projecting radially outwardly therefrom and formed integrally therewith. As illustrated in FIG. 3, each guide member 22 of one pair may be formed integrally with the spindle 20, as well as with a guide rail 24 of the adjacent pair. Preferably, a planar web 34 is provided extending between a guide rail 22 of one pair and the adjacent guide rail 24 of another pair. The planar webs 34 structurally rigidify the wrench head 10 and prevent the guide rails 22 and 24 from deflecting or distorting under heavy torque loads.

Each pair of guide rails 22 and 24 cooperate to define a channel 26 having parallel side walls and extending radially outwardly from spindle 20. In the illustrated embodiment, four channels 26 are shown, symmetrically spaced about the periphery of the wrench head 10. It is to be understood that while four channels 26 are shown the subject invention is not intended to be limited thereby. More specifically, the illustrated embodiment is intended for use with spanner nuts of various diameters having four symmetrically spaced locking recesses (or a multiple thereof). Other variations of the wrench head 10, which would fall within the scope of the subject invention, include configurations wherein, for example, three channels are provided spaced apart 120°, to accommodate spanner nuts of various diameters having three symmetrically spaced locking recesses (or a multiple thereof).

Figure 6:
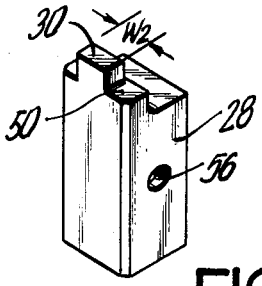
FIG. 6 is a perspective view of a rectangular insert having an extending tang for use in conjunction with the adjustable wrench head of the subject invention.

Channels 26 are adapted to receive inserts 28 which are generally rectangular in configuration. Preferably, the width W1 of the insert substantially corresponds to the width of the channel 26 to insure a relatively stable interfit therebetween. As illustrated in FIG. 6, insert 28 is provided with a projecting tang 30 adapted for engagement with a locking recess of a spanner nut. More specifically, the axially projecting end of the insert 28 is provided with an elevated shelf portion 50, from which tang 30 projects. As illustrated in FIG. 1, when an insert 28 is mounted within a channel 26 of the wrench head 10, tang 30 projects axially outwardly beyond the front end of the spindle 20. Preferably, the width W2 of the tang 30 substantially corresponds to the width of a locking recess of a spanner nut.

In accordance with the subject invention, a locking means is provided for maintaining the desired location of the insert 28 within the channel 26, relative to the spindle 20. By this arrangement, the inserts 28 can be adjusted such that the tangs 30 thereof coincide with the locking recesses of a selected spanner nut. The locking means includes a radially extending, elongated slot 54 provided in each guide rail 22. Further, and as illustrated in FIG. 6, each insert 28 is provided with a threaded aperture 56. The insert 28 is mounted within channel 26 such that aperture 56 is aligned with slot 54. A screw 58, such as an allen head screw illustrated in the Figures, is passed through slot 54 and threadably engaged with aperture 56 in the insert 28. By tightening the screw 58, the radial location of the insert 26 relative to the spindle 20 can be maintained.

In order to supply the necessary torque to the wrench head 10, a means is provided to facilitate the connection of the wrench head to a suitable driver. As illustrated in FIG. 3, central spindle 20 is provided with a square recess 60, adjacent its rear end. Preferably, and as illustrated in FIGS. 1 and 5, recess 60 may extend the entire length of spindle 20. Recess 60 is adapted to receive an elongated square driver element 62 which may be an extension of a power tool or a torque handle. To secure the driver element 62 within recess 60, a radially extending aperture 64 may be provided through spindle 20 adjacent its rear end, as illustrated in FIGS. 3 and 4. The end of driver element 62 is provided within an aperture 66 which is in register with aperture 64 in spindle 20. By this arrangement, a pin 68 or other holding device may be inserted through the registered apertures 64, 66 to maintain the driver element 62 within the spindle 20.

In operation, the wrench head 10 of the subject invention can be adapted for use with spanner nuts of various diameters. Initially the diameter of the spanner nut must be determined. More specifically, the operator must initially determine the radius of the imaginary circle which coincides with the locking recesses of the spanner nut. This radius is generally the same for spanner nuts, having a particular outer diameter, whether the nut is of the type illustrated in FIG. 1, or the type illustrated in FIG. 2.

After the radius of the spanner nut is determined, the operator merely adjusts the radial positions of the inserts 28 such that the tangs 30 are spaced from the center of the spindle 20 a distance equal to that radius. More specifically, each screw 58 is loosened, enabling the insert 28 to be slidably moved within channel 26. When each tang 30 of an insert 28 is spaced from the center point of spindle 20 a distance equal to the radius of the spanner nut, the associated screw 58 is tightened, securing the insert 28 in place. This procedure is repeated with each of the inserts 28 until the tangs 30 are spaced the proper distance R1 from the center of the spindle 20 readying the wrench head 10 for use. As illustrated in FIG. 1, the wrench head 10 is then moved in the direction of arrow A, until the tangs 30 are received in the locking recesses 32 of the spanner nut 12. Rotation of the wrench head 10, via driver element 62, will cause the spanner nut to rotate therewith. It is apparent that the wrench head 10 can be utilized with both types of spanner nuts illustrated in FIGS. 1 and 2 respectively.

In FIGS. 1, 4 and 5, inserts 28 are oriented such that the slidable movement thereof is capable of achieving the maximum possible radius, R2, of the illustrated wrench head 10. More specifically, when the inserts 28 are shifted to their radially outermost positions, each tang 30 will be disposed adjacent the radially outermost end of channel 26. In order to enable the wrench head 10 to be adjusted to achieve its maximum possible radius R3, it is necessary to reverse the orientation of the inserts 28 such that the projecting tangs 30 are adjacent the radially innermost ends 70 of the channels 26. The orientation of the inserts 28 are reversed by removing screws 58 from apertures 56 enabling the inserts 28 to be withdrawn from channels 26. The inserts are then rotated through 180° and reinserted into the channels 26. By this arrangement, the inserts may be moved inwardly such that tangs 30 are adjacent the radially innermost portions 70 of the channels 26 to achieve a radius R3. The inserts are secured in the manner described above with screws 58 being engaged within threaded apertures 56 of the inserts. By utilizing both orientations of inserts 28, the wrench head 10 is capable of accommodating spanner nuts having radii ranging from R3 to R2. Preferably, the dimensions of the wrench head 10 are configured to accommodate spanner nuts ranging from 0.86 to 2.5 inches.

In summary, there is provided a new and improved adjustable wrench head 10 for use with spanner nuts of various diameters. The wrench head 10 includes an elongated driving spindle 20 having a plurality of opposed pairs of planar guide rails 22, 24 projecting radially outwardly from the spindle and connected thereto. Each opposed pair of guide rails defines a channel 26 which is adapted to receive a rectangular insert 28 that is movable radially therein, relative to the central spindle. Each insert includes a tang 30 which projects axially beyond the front end of the spindle and is adapted to engage the locking recesses of the spanner nut. A means is provided for securing the insert within the channel at a fixed radial location. By this arrangement, the inserts may be adjusted to correspond to the radius of the spanner nut such that the tangs thereof are readily receivable in the locking recesses of the spanner nut. Preferably, a plurality of planar webs are provided extending between one guide rail of one pair and the adjacent guide rail of another pair, to structurally rigidify the wrench head.

While the subject invention has been described and illustrated with reference to a preferred embodiment, it would be obvious that various changes and modifications can be made therein without departing from the spirit or the scope of the subject invention as defined by the appended claims.

What is claimed is:

1. An adjustable wrench head for use with spanner nuts of various sizes, each spanner nut having a plurality of locking recesses, said wrench head comprising:

a substantially cylindrical body including a central elongated driving spindle having front and rear ends, said body further including a plurality of opposed pair of planar guide rails projecting radially outward from said spindle and perpendicularly outward from said body and formed integrally therewith, each said opposed pair of guide rails defining a radially extending channel, with said channels being symmetrically spaced about the periphery of said spindle, said body further including a plurality of web portions, said web portions extending between one guide rail of one said pair and the adjacent guide rail of said another pair to form a rigid structure capable of transmitting torque;

a plurality of generally rectangular inserts, with one of said inserts being received in each said channel of said body, said inserts being radially movable within said channel relative to said spindle, with the width and height of each said insert substantially corresponding to the spacing between and the outward extent of the associated pair of guide rails to insure torque transmitting engagement between said insert and said pair of guide rails, and wherein each said insert includes a tang, said tangs projecting axially beyond the front end of said spindle for engaging the locking recesses of a spanner nut; and locking means for securing each said insert within said channel at a predetermined radial position, said locking means comprising a slot constructed in at least one of said pair of guide rails and a screw adapted to engage the insert through the slot to allow maximum lockable radial movement of the insert.

* * * * *